US005201143A

United States Patent [19]

Nakanishi

[11] Patent Number: 5,201,143

[45] Date of Patent: Apr. 13, 1993

[54] WINDOW STAY

[76] Inventor: Yoshikazu Nakanishi, 1-11, Kandaizumi-cho, Chiyoda-ku, Tokyo, Japan

[21] Appl. No.: 633,161

[22] Filed: Dec. 26, 1990

Related U.S. Application Data

[63] Continuation of Ser. No. 391,453, Aug. 9, 1989, abandoned.

[30] Foreign Application Priority Data

Nov. 26, 1988 [JP] Japan ..... 63-298840

[51] Int. Cl.[5] ..... E05F 11/24

[52] U.S. Cl. ..... 49/339; 49/345

[58] Field of Search ..... 49/81, 83, 85, 87, 95, 49/96, 104, 107, 109, 339, 341, 342, 344, 345

[56] References Cited

U.S. PATENT DOCUMENTS

| | | | |
|---|---|---|---|
| 2,926,397 | 3/1960 | Vuncannon | 49/85 X |
| 2,981,538 | 4/1961 | Bennett | 49/341 X |
| 3,071,219 | 1/1963 | Vuncannon | 49/341 X |
| 3,257,755 | 6/1966 | Lewis | 49/345 X |
| 4,301,622 | 11/1981 | Dunsmoor | 49/345 X |
| 4,823,508 | 4/1989 | Allen | 49/341 X |

FOREIGN PATENT DOCUMENTS

| | | | |
|---|---|---|---|
| 2081804 | 2/1982 | United Kingdom | 49/345 |

*Primary Examiner*—Peter M. Cuomo
*Assistant Examiner*—Jerry Redman
*Attorney, Agent, or Firm*—Emmanuel J. Lobato; Robert E. Burns

[57] ABSTRACT

A window stay is provided for a casement type window so that its window sash is shifted outwardly from the window frame as it is being opened. The window stay comprises a first arm, a second arm, and a third arm associated with a driving rod. The first arm has its respective ends pivotally attached to the window sash and the window frame and swings the window sash in relation to the window frame as the driving rod is operated. The second arm has its ends respectively pivotally attached to the window sash and the driving rod and swings the window sash in relation to the first arm as the driving rod is operated. The third arm has its ends respectively pivotally attached to the first arm and the driving rod and swings the first arm in relation to the window frame in accordance with the movement of the driving rod.

5 Claims, 4 Drawing Sheets

WINDOW STAY

This is a continuation of application Ser. No. 07/391,453, filed Aug. 9, 1989, now abandoned.

BACKGROUND OF THE INVENTION

This invention relates to a casement-type window, in which the window sash is shifted outwardly from the window frame by a window stay while the window is being opened.

There is a known window in which a window stay comprising a pair of arms is employed to swingably connect a window sash to a window frame. While a first arm is used to shift the window sash outwardly from the window frame, the second arm is used to swing the window sash with respect to the first arm.

This window stay is provided with pivot points, the frictional force of which is increased to hold the window sash in any open position. However, the holding force thus obtained is still insufficient. Moreover, while the window stay is designed for use in pushing or pulling the window sash open or shut, it has been found that it is not easy to open or shut a large heavy window sash against wind pressure. On occasion, the user may also have to run the risk of leaning out of the window.

Another known window stay is designed to open or shut a plurality of interlocking window sashes with one crank handle. The difficulty in this case is that the window stay is unable to increase the lead-out distance of the window sashes and to open or shut the window sashes easily.

SUMMARY OF THE INVENTION

An object of the present invention is to provide a window with a window stay capable of firmly holding a window sash in an open position, assuring the opening or closing of the window sash not only with safety but also with ease, and increasing the lead-out distance of the window sash.

Another object of the present invention is to provide a window stay capable of readily opening or shutting a plurality of interlocking window sashes with a greater lead-out distance by means of one crank handle.

To accomplish the aforesaid objects, the present invention provides a window stay comprising a first arm for swingably connecting a window sash to a window frame, a second arm for swinging the window sash with respect to the first arm, and a third arm for swinging the first arm with respect to the window frame. A driving rod is connected to the third arm and is reciprocated so that the three arms operate to open or close the window sash. The window stay is provided with a crank handle for reciprocating the driving rod.

A plurality of window stays may be respectively provided for a plurality of interlocking parallel window sashes. These window stays are connected to a common driving rod operated by a crank handle.

The window stays may be respectively provided at the top and bottom parts of a window sash; and such window stays may be interconnected by a power transmitting shaft also operated by a crank handle.

BRIEF DESCRIPTION OF THE DRAWING

The invention will now be described in detail with reference to the accompanying drawings, in which.

DETAILED DESCRIPTION OF THE PREFERRED EMBODIMENT

Figure 1:
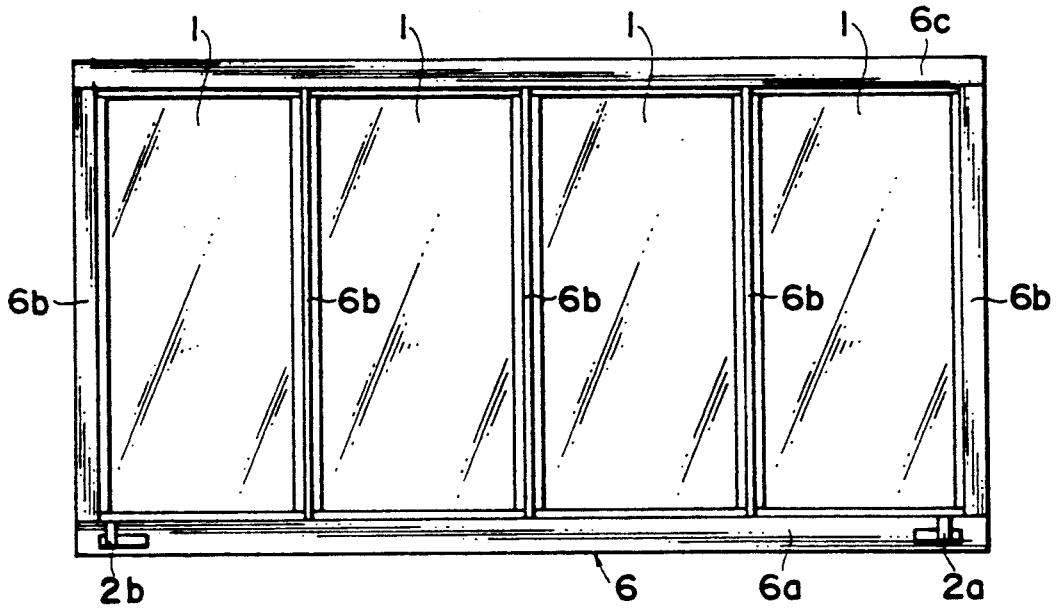
FIG. 1 is a front view on a reduced scale of a window embodying the present invention.
Figure 5:
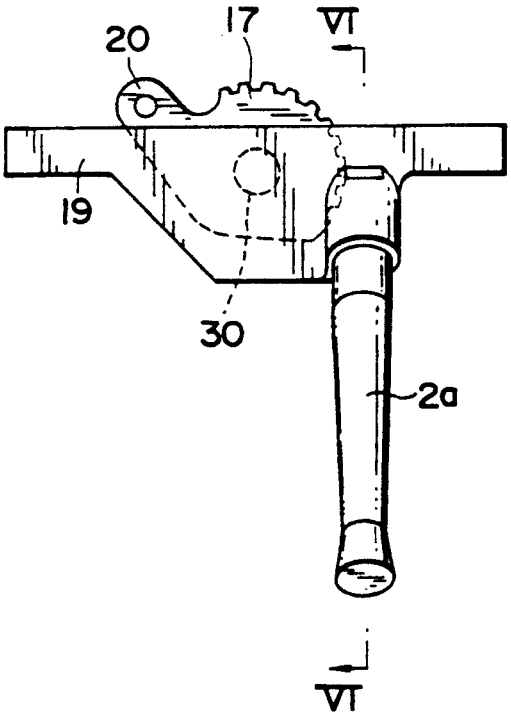
FIG. 5 is a plan view of a crank handle for use in operating the window stays.
Figure 6:
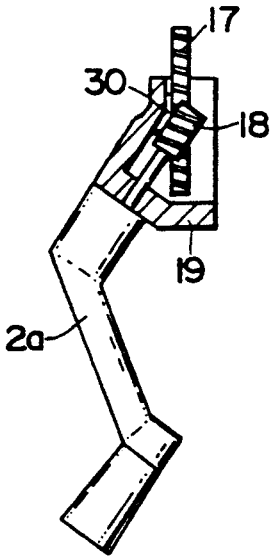
FIG. 6 is a sectional view taken on line VI—VI of FIG. 5.

FIG. 1 shows a window frame having four parallel, interlocking window sashes. The two right-hand window sashes 1 are opened and closed by a right-hand crank handle 2*a*, while the two left-hand sashes 1 are opened and closed by a left-hand crank handle 2*b*.

Window stays ar respectively provided at the top and bottom parts or sides of each window sash 1, which is shifted outwardly from the window frame by swinging the window sash 1 around a fixed pivot point 8 and also swinging such window sash with respect to a movable pivot point 10.

Figure 2:
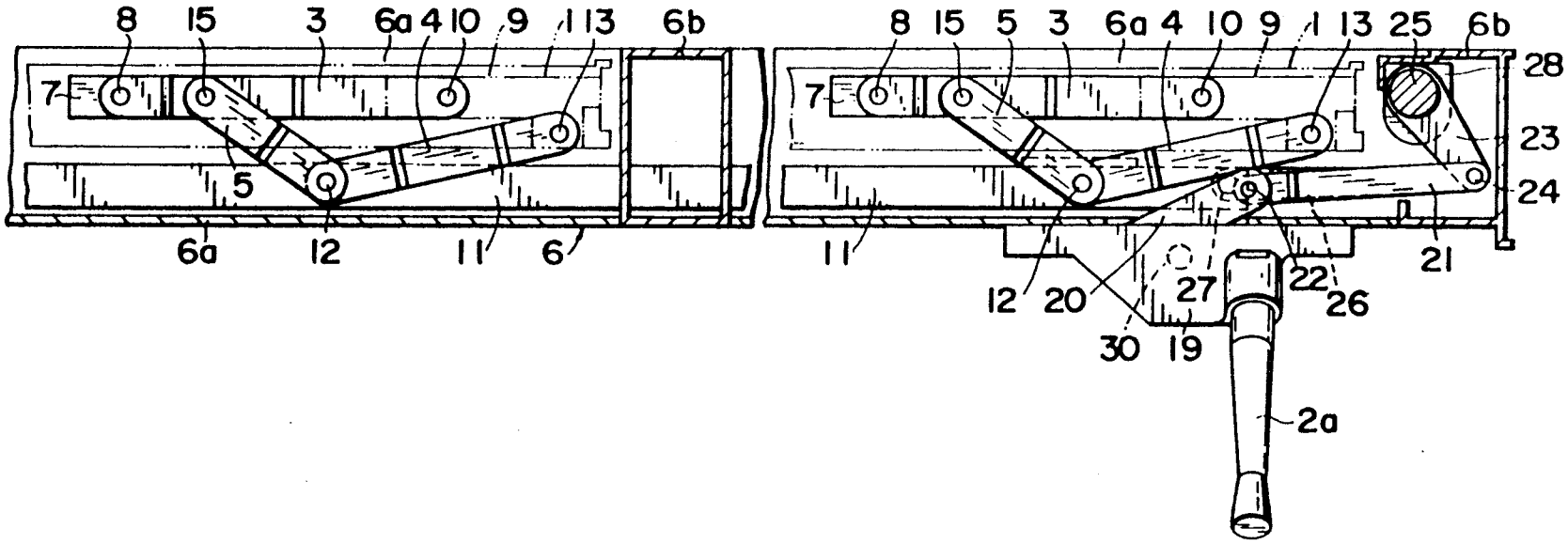
FIG. 2 is a plan view, with parts in section and with parts cut away, illustrating the window stays in their closed position in the bottom portion of a window frame.
Figure 3:
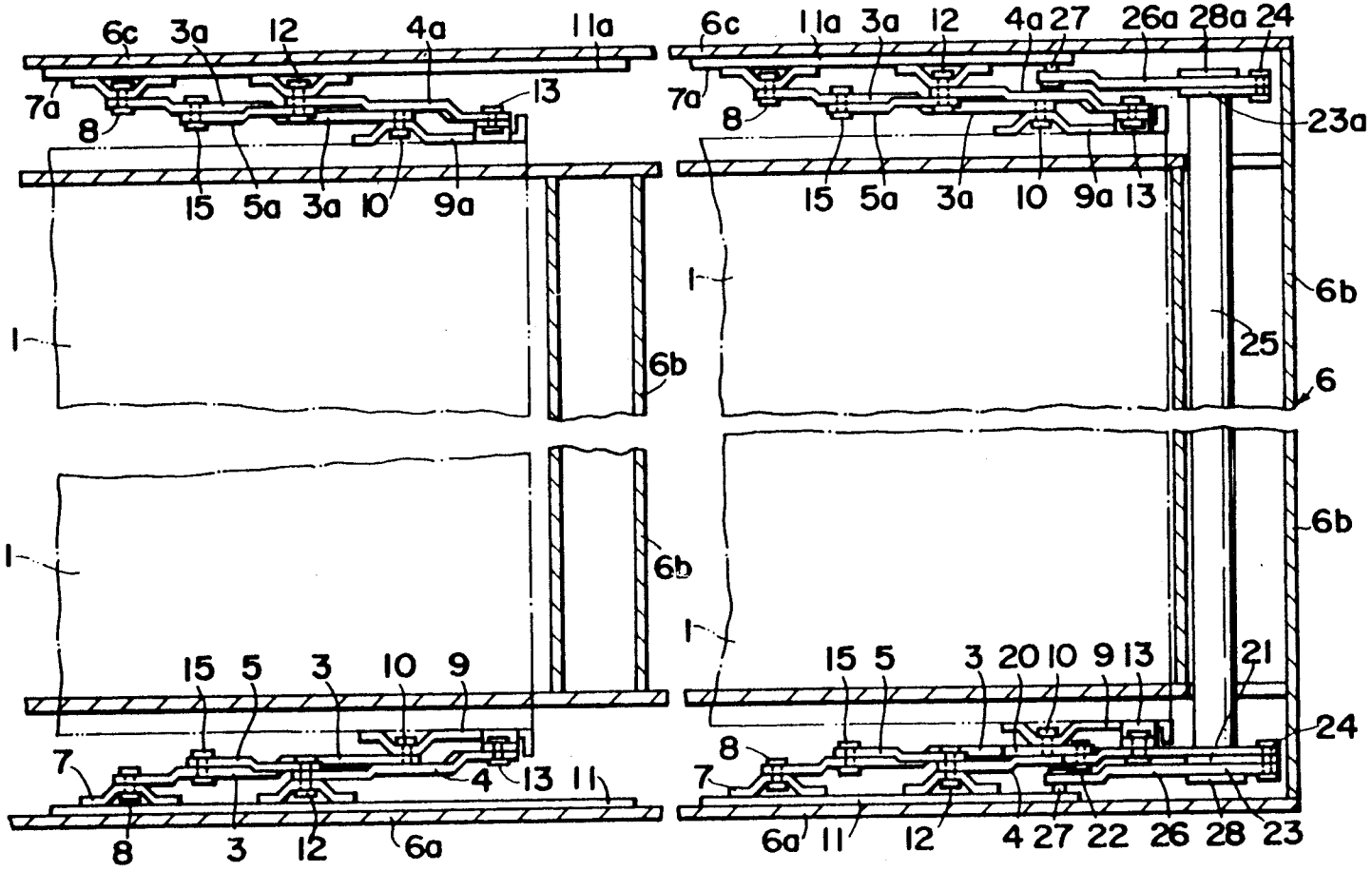
FIG. 3 is a front view, with parts in section and with parts cut away, illustrating the window stays in their closed position.
Figure 4:
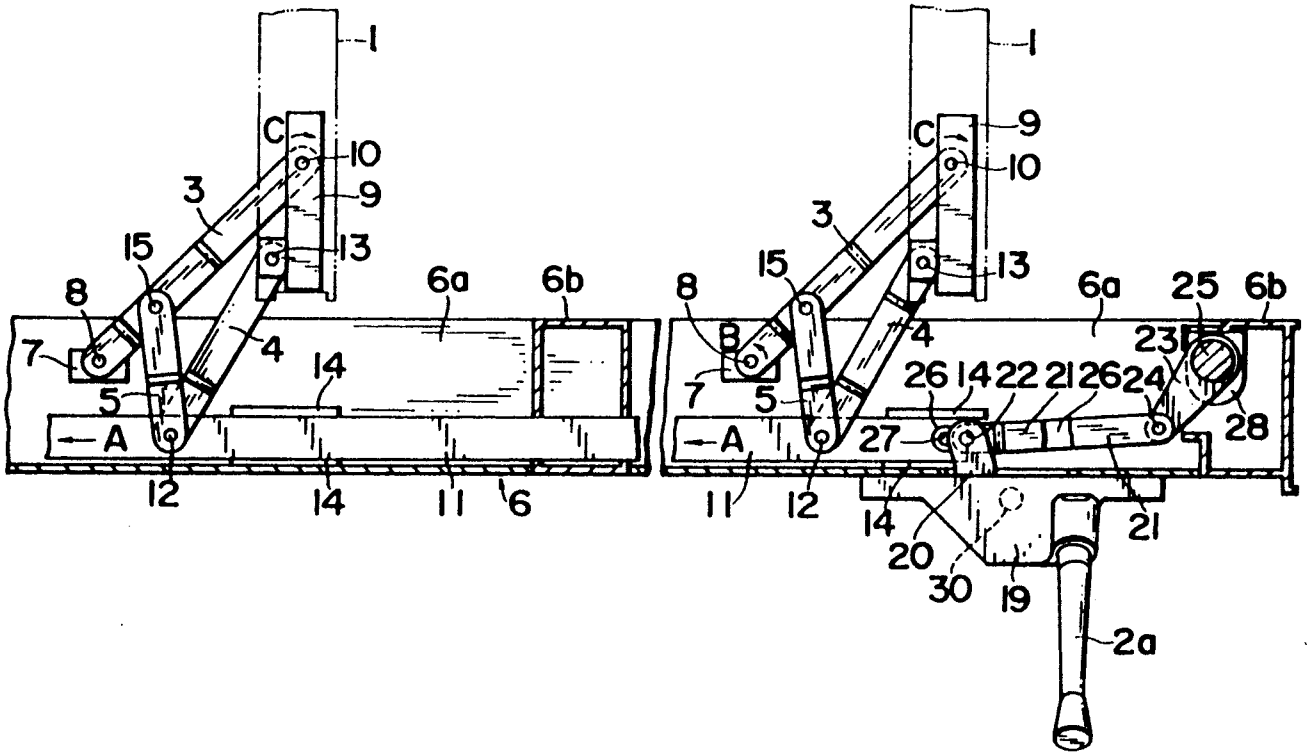
FIG. 4 is a plan view, similar to FIG. 2 illustrating the window stays in their open position.

The window stay shown in FIGS. 2 to 4 is respectively attached to the bottom of each window sash 1 and is provided with a first arm 3, a second arm 4, and a third arm 5. One end of the first arm 3 is pivotally attached by pin 8 to a first mounting plate 7 fixed to the bottom side 6*a* of the window frame 6; the other end of first arm 3 is pivotally attached by pin 10 to a second mounting plate 9 fixed to the bottom side of the window sash 1. The first arm 3 serves to swing the window sash 1 around the pin 8 from the open position to the closed position and vice versa. One end of the second arm 4 is pivotally attached to a driving rod 11 by a pin 12; the other end of the second arm 4, is pivotally attached by a pin 13 to the second mounting plate 9 fixed to the bottom side of the window sash. The second arm 4 serves to swing the window sash 1 about the pin 10 of the first arm 3.

The driving rod 11 is in the form of a long, narrow strip and is incorporated in the bottom side 6*a* of the window frame 6 in such a manner as to extend longitudinally of the bottom window frame side. It is moved in either longitudinal direction along a guide 14. The reciprocatory movement of driving rod 11 serves to swing the window sash about pin 10 via the second arm 4.

One end of the third arm 5 is pivotally attached by a pin 15 to first arm 3 at a point between the ends of such first arm; the other end of third arm 5 is pivotally attached to the driving rod by pin 12 also used for the second arm 4. The other end of third arm 5 may optionally be pivotally attached to the driving rod 11 by a separate pin (not shown) set apart from pin 12. This third arm 5 swings the first arm 3 around the pin 8 as the driving rod 11 is reciprocated.

Window sash 1 is shown in FIG. 2 in the closed position. When the driving rod 11 is moved in the direction of arrow A in that state, the third arm 5 swings the first arm 3 at pin 8 in the direction of arrow B and consequently causes the window sash 1 to swing around pin 8 in the same direction. Simultaneously, the second arm 4 is caused to swing with the window sash 1 at pin 10 in the direction of arrow C. Accordingly, window sash 1 is, as shown in FIG. 4, opened in a direction perpendicular to the bottom side 6a of the window frame and is shifted outwardly from the bottom window frame side 6a so that a gap is formed between the outside surface of the window sash and a vertical side 6b of the window frame. This gap brings about good ventilation and at the same time makes it possible to clean the exterior surface of the window sash.

When the driving rod 11 is moved in the direction opposite to arrow A when the window sash 1 is in the open position, each of the arms 3, 4, 5 respectively swings in the direction opposite to the opening movement so that the window sash 1 is closed at the bottom side 6a of the window frame 6.

The driving rod 11 is driven by a driving mechanism comprising a worm wheel 17, a worm 18 meshing with the worm wheel 17, the worm wheel 17 and the worm 18 being enclosed in a housing 19, a crank handle 2a rotatably mounted on the housing 19 for rotation of the worm 18, and a driving arm 20 extending radially from the worm wheel 17 and pivotally attached by a pin 22 to one end of a transmitting rod 21. The other end of the transmitting rod 21 is pivotally attached by a pin 24 to one end of a crank arm 23 fixed to a transmitting shaft 25 in such a manner as to rotate integrally therewith. One end of a connecting rod 26 is pivotally attached by pin 24 to one end of the crank arm 23; the other end of the connecting rod 26 is pivotally attached by a pin 27 to one end of the driving rod 11 (FIG. 3).

When the crank handle 2a is rotated, the driving arm 20 is rotated on a shaft 30 via the worm 18 and the worm wheel 17. The driving arm 20 rotates the crank arm 23 via the transmitting rod 21, and the crank arm 23 reciprocates the driving rod 11 via the connecting rod 26. The window sash is thereby locked by a worm gearing and thus is unable to rotate from the window sash side and is immovably held in any desired open position.

The transmitting shaft 25 is incorporated within the vertical hollow side 6b of the window frame by means of bearing brackets 28, 28a and extends from the bottom to the top of the vertical side 6b. The top of such shaft is connected via a crank arm 23a and a connecting rod 26a to a top stay provided at the top side of the window sash 1.

The crank arm 23a, the connecting rod 26a, and the stay at the top side of the window sash 1 constitute a combination corresponding or similar to that of the crank arm 23, the connecting rod 26, and the stay at the bottom side of the window sash.

The crank arm 23a is fastened to the top of the transmitting shaft 25. One end of a connecting rod 26a is pivotally attached by pin 24 to one end of the crank arm 23a, the other end of the connecting rod 26a is pivotally attached by pin 27 to one end of a driving rod 11a. As regards the stay, one end of a first arm 3a is pivotally attached by pin 8 to a first mounting plate 7a fixed to the top side 6c of the window frame; the other end is pivotally attached by pin 10 to a second mounting plate 9a fixed to the top side of the window sash 1. Like the bottom first arm 3, the top first arm 3a also swings the mounting plate 9a together with the window sash 1 around the pin 8.

One end of a second arm 4a is pivotally attached by pin 12 to the driving rod 11a in the top side 6c of the window frame; the other end of the second arm is pivotally attached to the mounting plate 9a by pin 13. Like the bottom second arm 4, the top second arm 4a also swings the mounting plate 9a together with the window sash 1 at pin 10.

One end of a third top arm 5a is pivotally attached to driving rod 11a by pin 12 also used for the second arm 4a. The other end of such third arm is pivotally attached by pin 15 to the first arm 3a at a point between the ends of the first arm 3a. Like the bottom third arm 5, the top third arm 5a also swings the first arm 3a at pin 8. When the crank handle 2a is rotated, the top crank arm 23a swings together with the bottom crank arm 23 via the transmitting shaft 25 and operates the first arm 3a, the second arm 4a, and the third arm 5a simultaneously with the bottom arms 3, 4, 5 so as to open or close the window sash 1.

Each window sash is provided with the above-described arms, namely, first arms 3, 3a, second arms 4, 4a and third arms 5, 5a between the top side of the window sash 1 and the top side 6c of the window frame and between the bottom side of the window sash and the bottom side 6a of the window frame, as indicated, by the respective common reference numerals. Moreover, the second arms 4, 4a and third arms 5, 5a are pivotally attached to the respective driving rods 11 and 11a incorporated within the bottom side and the top side of the window frame. The plurality of window sashes can thus be opened or closed by operating one crank handle 2a.

What is claimed is:

1. A window comprising, a rectangular window frame having oppositely disposed horizontal sides and oppositely disposed vertical sides, a first driving rod associated with one of the horizontal sides of the window frame and reciprocatory longitudinally of said one horizontal side, a first window sash arranged parallel to one of the vertical sides of the window frame and having a top side and a bottom side, and a first window stay including a first arm having one end pivotally attached to said one horizontal side of the window frame and its other end pivotally attached to the bottom side of the window sash, said first arm serving to swing the window sash about a point of attachment of the first arm to said window frame as the driving rod is operated, a second arm having one end pivotally attached to the bottom side of the window sash and its other end pivotally attached to the driving rod, said second arm effective to swing the window sash about the point of attachment of the first arm to said window sash as the driving rod is operated, and a third arm having one end pivotally attached to the first arm between both ends of said first arm and its other end pivotally attached to the driving rod, and said third arm serving to swing said first arm together with the window sash about the point of attachment of the first arm to the window frame as the driving rod is operated a first mounting plate fixed to said one horizontal side of the window frame at the point of attachment of the first arm to said window frame, and a second mounting plate fixed to the bottom side of the window sash at respective points of attachment of the first arm and the second arm to said window sash, a second driving rod associated with the other horizontal side of the window frame and reciprocatory longitudinally of such other horizontal side, a second window stay corresponding to the first window stay and associated with the top side of said first window sash, a transmitting shaft associated with one of the vertical sides of the window frame and extending vertically between the two horizontal sides of said window frame, a first connection between the bottom end of the transmitting shaft and the first driving rod, and a second connection between the top end of the transmitting shaft and the second driving rod, whereby said first driving rod and said second driving rod are simultaneously operated upon operation of said transmitting shaft, said first connection including a first crank arm fixed to the bottom and of the transmitting shaft, and a first connecting rod between said first crank arm and the first driving rod, and the second connection including a second crank arm fixed to the top end of the transmitting shaft, and a second connection rod between said second crank arm and the second driving rod, a crank handle rotatably mounted on said one horizontal side of the window frame, a worm attached to an inner end of said crank handle, a worm wheel drivable by said worm, a driving arm extending radially from said worm wheel, and a transmitting rod pivotally connecting said driving arm to said first crank arm and drivable without rotation about a longitudinal axis thereof for operation of said transmitting shaft upon rotation of said crank handle, a housing attached to said one horizontal side of the window frame for mounting of the crank handle thereon, and said worm and worm wheel being positioned in said housing.

2. A window according to claim 1, which includes at least one other window sash corresponding to the first window sash and arranged in parallel side-by-side relation thereto, and a window stay corresponding to the first window stay and associated with the bottom side of each such other window sash, whereby the window sashes move in unison upon operation of the driving rod.

3. A window according to claim 1, which includes means associated with said one horizontal side of the window frame for operating the first driving rod reciprocably.

4. A window according to claim 1, in which each horizontal side of the window frame is substantially hollow in cross section, the first driving rod being disposed within said one bottom horizontal side and the first window stay being positioned within said one hollow horizontal side and extendable therefrom, and the second driving rod being disposed within said other hollow horizontal side and the second window stay also being disposed within said other hollow horizontal side and extendable therefrom.

5. A window according to claim 1, in which said one vertical side of the window frame is essentially hollow in cross section and encloses said transmitting shaft.

* * * * *